US006339406B1

(12) United States Patent
Nesic et al.

(10) Patent No.: US 6,339,406 B1
(45) Date of Patent: Jan. 15, 2002

(54) CIRCULAR POLARIZED PLANAR PRINTED ANTENNA CONCEPT WITH SHAPED RADIATION PATTERN

(75) Inventors: Aleksandar Nesic, Novi Beograd (YU); Veselin Brankovic, Fellbach (DE)

(73) Assignee: Sony International (Europe) GmbH, Koln-Ossendorf (DE)

( * ) Notice: Subject to any disclaimer, the term of this patent is extended or adjusted under 35 U.S.C. 154(b) by 0 days.

(21) Appl. No.: 09/195,378

(22) Filed: Nov. 18, 1998

(30) Foreign Application Priority Data

Nov. 25, 1997 (EP) ..... 97120643

(51) Int. Cl.[7] ..... H01Q 21/26
(52) U.S. Cl. ..... 343/797; 343/795; 343/700 MS
(58) Field of Search ..... 343/795, 797, 343/700 MS, 767, 770; H01Q 21/00, 21/26, 9/28

(56) References Cited

U.S. PATENT DOCUMENTS

| | | | | |
|---|---|---|---|---|
| 5,021,799 A | | 6/1991 | Kobus et al. | 343/795 |
| 5,691,734 A | * | 11/1997 | Davies | 343/795 |
| 5,708,446 A | * | 1/1998 | Laramie | 343/795 |

FOREIGN PATENT DOCUMENTS

| | | |
|---|---|---|
| EP | 0 243 289 | 10/1987 |
| FR | 2 736 212 | 1/1997 |

OTHER PUBLICATIONS

Nesic, A., et al.: "New Printed Antenna with Circular Polarization", Proceedings of the 26th European Microwave Conference 1996, Prague, Sep. 9–13, 1996, vol. 2, No. Conf. 26, Sep. 9, 1996, European Microwave Conference Committee, pp. 569–573.

Ding, X., et al.: "Novel Broadband Slot Antenna with Low Cross–Polarization", Proceedings of the 26th European Microwave Conference 1996, Prague, Sep. 9–13, 1996, vol. 2, No. Conf. 26, Sep. 9, 1996, European Microwave Conference Committee, pp. 574–578.

Kazama, Y.: "One–Point Feed Printed Crossed Dipole with a Reflector Antenna Combined with a Reactively Loaded Parasitic Loop for Land Mobile Satellite Communication Antennas", IEE Proceedings H. Microwaves, Antennas & Propagation, vol. 140, No. 5, Part H, Oct. 1, 1993, pp. 417–420.

* cited by examiner

*Primary Examiner*—Hoanganh Le
(74) *Attorney, Agent, or Firm*—Frommer Lawrence & Haug LLP; William S. Frommer; Jol H. Shallenburger

(57) ABSTRACT

The present invention relates to a circular polarized antenna with a dielectric substrate (11) comprising a front and a back dielectric face (12, 13), a first and a second subantenna (14, 15), each comprising a first and a second element for radiating and receiving circular polarized electromagnetic signals, the first and second subantenna being arranged orthogonal to each other on the dielectric substrate (11) and having essentially conjugate complex impedances, a transmission line (18, 25, 30, 46) connected with the first and second subantenna for transmitting signals to and from said first and second subantenna and a reflector (16) spaced to and parallel with the back face (23) of the dielectric substrate (11), a low loss material (17) being located between said reflector means (16) and said back face (13). This structure provides a radiation pattern with a variable shape. Further, this antenna can be printed onto a corresponding substrate and therefor be produced at low cost.

11 Claims, 10 Drawing Sheets

CIRCULAR POLARIZED PLANAR PRINTED ANTENNA CONCEPT WITH SHAPED RADIATION PATTERN

The present invention relates to an antenna for radiating and receiving circular polarized electromagnetic signals with microwave or mm-wave frequencies.

Such antennas are particularly interesting for communication scenarios, in which a light of the sight (LOS) propagation is to be used. The typical application can be in satellite-earth-communication, indoor LOS wireless LANS or outdoor LOS private links. The special advantage of such circular polarized antennas, besides that there is no need for an antenna orientation, is the feature of the additional physical attenuation of the reflected waves due to the polarization rotation changes, which makes the propagation channel much better and the overall system more resistant in the case of a multipath propagation. This advantage appears particularly when a LOS path is existing.

There are mainly two major application areas, where circular polarized antennas with particularly shaped antenna characteristics are required. The first application is a uniform coverage application, in which a circular polarized base or remote station antenna communicates with a mobile or stationary antenna in an indoor environment or in which a circular polarized satellite antenna communicates with earth antennas. The second application is an outdoor application, in which a circular polarized antenna located on an land mobile platform (e.g. a car or a train) communicates with a satellite.

Figure 1:
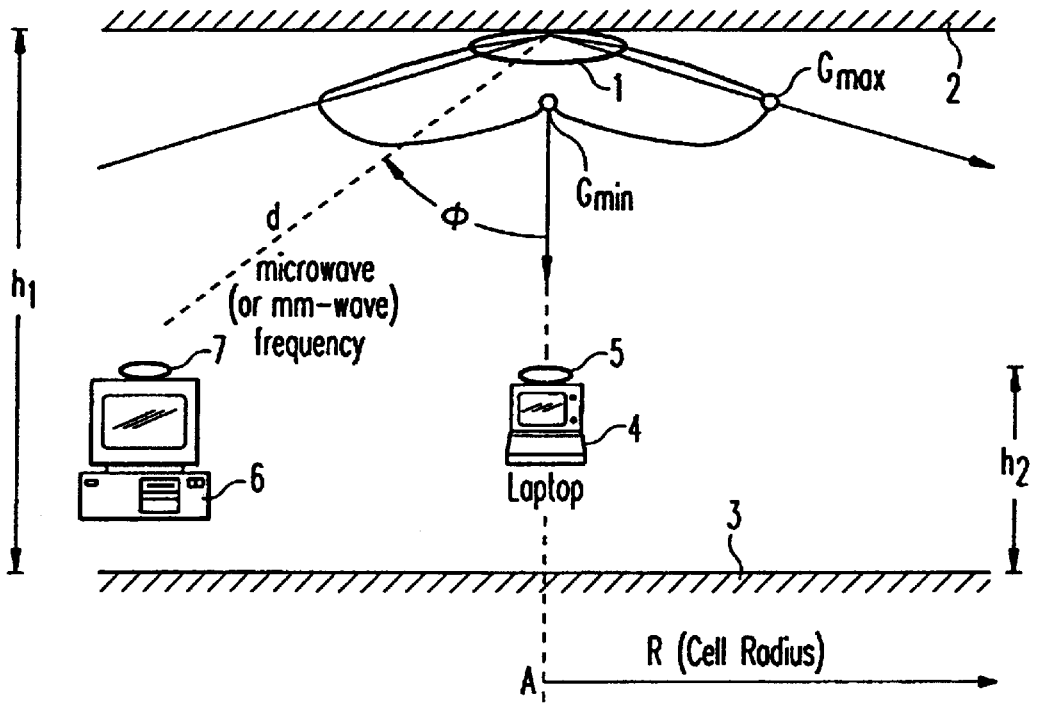

In the first application the uniform coverage is the main problem. In an indoor application, which is e.g. shown in FIG. 1, the uniform coverage is required in the case, where an indoor circular polarized antenna 1 for a base station or a remote station with a LOS communication link, e.g. with an antenna 5 located on a laptop 4 or an antenna 7 located on a personal computer 6, as shown in FIG. 1, is considered. If the circular polarized antenna 1 has a common radiation pattern, the signal strength Gmax at the edge of the receiving zone is attenuated much more compared to the strength Gmin in direction of a central axis A of the circular polarized antenna 1 because of the fact that the receiver at the edges receives electromagnetic waves, which have passed a larger distance, compared to those in the center of the receiving antenna, so that the physical attenuation is larger. This difference can be clearly seen in FIG. 1, where one has shortest distance to larger distance ratio variations between 1:4 to 1:8 leading to a physical attenuation level difference from 12 to 18 dB. In this case and if $h_2-h_1=1{,}5$ m, the cell diameter will be between 11.6 m and 27,3 m.

Figure 2:
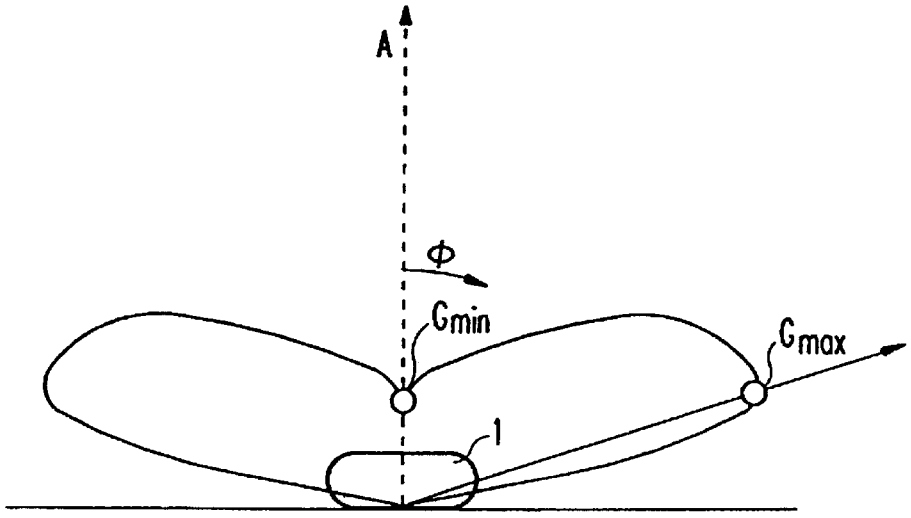

In an outdoor environment, in which a circular polarized satellite antenna is in communication with one or more earth antennas the uniform coverage problem described above is similar. The following explanations are related to the indoor environment, but are also true for the outdoor environment of the first application. A constant flux illumination of a cell, for example in FIG. 1 a room with a ceiling 2 and floor 3, whereby the circular polarized antenna 1 is located in the middle of the ceiling 2, implies that the elevation pattern G(Φ) of the circular polarized antenna, i.e. the base station antenna 1 in the example of FIG. 1, ideally compensates the free space attenuation associated with the distance d between the transmitting antenna and the receiving antenna. In order to optimize the transmitted power level, e.g. by an increase of the communication ratio or a reduction of the transmitted power for a constant communication ratio, and to minimize the necessity of a power control or to minimize the required power control range, there are two approaches. The first approach is for a case, in which the receiving antenna is a pointed antenna, whereby the antenna pattern should correspond to the ideal radiation pattern of an antenna as shown in FIG. 2. In an ideal case, if a mobile or portable antenna terminal has a common antenna pointed directly to the circular polarized antenna (base station antenna), the elevation gain G of the ideal radiation pattern is designed by the following equation:

$$G=G\ \min\times\sec^2\Phi=G\times[(h_2-h_1)^2+R^2]/[(h_2-h_1)^2]\ \text{for}\ \Phi<\Phi\max$$

$$G=0\ \text{for}\ \Phi>\Phi\max$$

The parameters are shown and explained in reference to FIG. 1. $h_1$ is the vertical distance between the ceiling 2, on which the circular polarized antenna 1 is located, and the floor 3. $h_2$ is the vertical distance between the mobile antenna 5, 7 and the floor 3. R is the radial distance of the mobile antenna 5, 7 from the central axis A of the circular polarized antenna 1. d is the distance between the circular polarized antenna 1 and the corresponding mobile antenna 5, 7. Φ is the angle between the central axis A of the circular polarized antenna 1 and the direction of the distance d.

The maximum Gmax of the radiation pattern G occurs at Φ=Φmax and the minimum Gmin at Φ=0, i.e. the direction of the central axis A. A rough estimate of the antenna gain G can be obtained from the above formula in view of FIGS. 1 and 2, which represent the maximum directivity calculated for an ideal $\sec^2\Phi$ pattern as a function of R, $h_1$ and $h_2$, as is expressed in the above equation.

The second approach is that in a case, in which both communication antennas are the same, the sum of their radiation patterns should give the characteristics described in the above equation.

The problem of obtaining such an ideal radiation characteristic is partially solved in the state of the art for linear polarized antennas by utilizing only non-planar and non-printed structures, e.g. by a wave guide antenna with dielectric lenses or a monopole antenna with a shaped reflector. The first solution requires a very large dielectric body which increases the weight, size and finally the costs of the antenna. This antenna is therefore impractical for a production of a large number of antenna, especially for lower frequencies. The second solution has principle disadvantages in shadowing in the middle of the antenna pattern, in reproducibility problems as well as in a requirement for a very large reflector plane. Finally, both of these solutions do not show circular polarization and do not allow a printed planar assembly, which makes antenna solutions cheap in the production and more suitable for different applications.

Known circular polarized printed planar antennas usually utilize a microstrip technology or a strip-line with different variations of feeding effects. However, in these approaches is the main beam the same as the plane vector of the printed structure, so that a uniform cell coverage is not assured. Further, they only allow a relatively narrow band application due to the frequency selective matching and the axial ratio. One solution of achieving a circular polarization of the microstrip patches is by means of two feeding points within one patch, as in U.S. Pat. Nos. 5,216,430, and in 5,382,959. Another solution of achieving circular polarization of the microstrip patches by means of a particular shaping of the orthogonal patches by cutting the corners or by making notches are disclosed in EP 0434268B1 and in EP525726A1.

Figure 3:
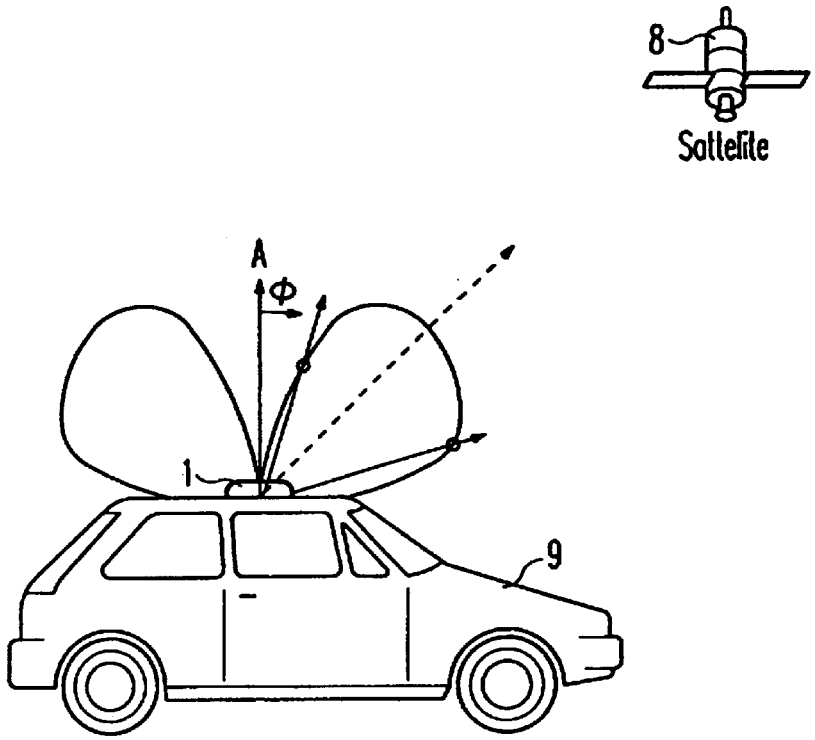
Figure 4:
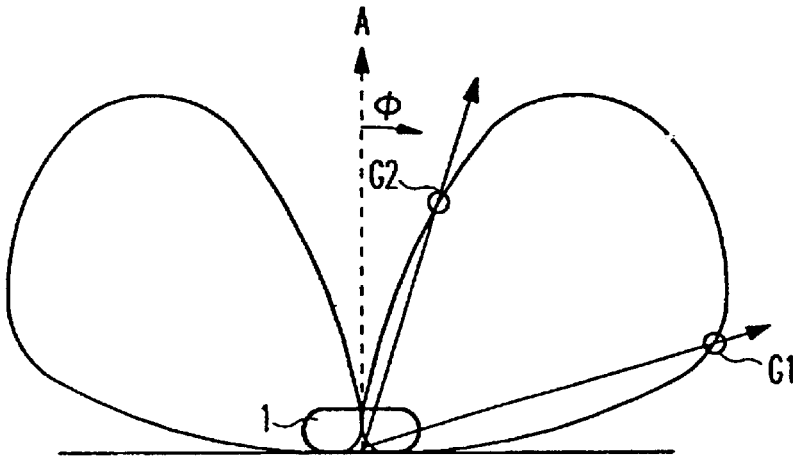

The second application for circular polarized antennas is in a case, in which circular polarized signals are transferred between a stationary satellite 8 and an circular polarized antenna 10, which is e.g. located on the roof of a car 9, as shown in FIG. 3. In FIG. 3, a typical scenario of such an outdoor application is shown. In FIG. 4, an ideal pattern for an outdoor application for a communication between a satellite 8 and a circular polarized antenna 10 located on a land mobile platform (car 9) is shown. For such an ideal antenna pattern, a tracking device for the circular polarized antenna 10 is not needed, so that regardless of the orientation of the car 9 the pattern of the circular polarized antenna 10 is pointed to the satellite 8.

For the scenario shown in FIG. 3, the inclination angle of the antenna pattern should not be sharp. For the ideal radiation pattern shown in FIG. 4. It is to be noted, that the maximum gain should be in the direction of $\Phi=30°-60°$, whereby $\Phi$ is the angle between the central axis A of the circular polarized antenna and the transmission direction. Within these angles, the stationary satellites are usually positioned.

The object of the present invention is therefore to provide an antenna for radiating and receiving circular polarized electromagnetic signals, which have a gain pattern close to the ideal gain pattern and can be produced at low costs.

This object is achieved by an antenna according to claim 1 with a dielectric substrate comprising a front and a back dielectric face, a first and a second subantenna means, each comprising a first and a second element for radiating and receiving circular polarized electromagnetic signals, said first and second subantenna means being arranged orthogonal to each other on said dielectric substrate and having essentially conjugate complex impedances, a transmission line means connected with said first and second subantenna means for transmitting signals to and from said first and second subantenna means, and a reflector means spaced to and parallel with said back face of said dielectric substrate, a low loss material being located between said reflector means and said back face.

The antenna according to the present invention has a gain pattern which is close to the ideal gain patterns shown in FIGS. 2 and 4 and can be produced in fully planar technology, so that the antenna can be produced at very low cost compared to known antennas. Moreover, the antenna can be integrated in a land mobile platform, e.g. in the roof of a car 9 as shown in FIG. 3 easily, so that much less difficulties with aerodynamic resistance occurs. Due to the inherently wide band application of the antenna according to the present invention, it is possible to apply this antenna for communications at about 1,6 GHz and for other applications in neighbored bands. Additional advantageous features of the antenna are a good axial ratio, a good antenna matching and a good antenna gain. Due to the radiation pattern, which is close to the ideal radiation patterns shown in FIGS. 2 and 4, the antenna according to the present invention is particularly suitable for the applications shown in and explained in view of FIGS. 1 and 2. The antenna is particularly suited for applications in which either a very low radiation (as shown in FIG. 4) or a minimum radiation (as shown in FIG. 2) in the direction of the central axis A of the antenna is required.

The circular polarization can be achieved if two orthogonal dipoles are fed with currents having their phases in quadrature and the same intensity. A phase difference of $\pi/2$ can be realized by feeding identical dipoles having the same complex impedances through transmission lines of electrical lengths differing by $\lambda/4$, wherein $\lambda$ is the electrical wavelength of the transmitted signals, or by a feeding network having some kind of reactive elements providing a phase difference of $\pi/2$.

According to the present invention, the two orthogonal dipoles are not the same, but are designed to have conjugate complex impedances, which means that the first dipole has an impedance of $Z_1=R-jX$ and the second dipole has an impedance of $Z_2=R+jX$, wherein R are the real parts and X are the imaginary parts.

Advantageous features of the present invention are defined in subclaims.

Advantageously, said first and said second subantenna means are either dipole means connected in parallel or slots connected in series by said transmission line means and have correspondingly chosen impedance values, so that the resulting impedance ideally has only a real part and is equal to the characteristic impedance $Z_c$ of the transmission line means used for feeding the antenna. Usually the characteristic impedance of the transmission line means is 50 Ohm, but could be any other real impedance like 75 Ohm etc. The resulting impedance for the two dipoles connected in parallel is therefore $Z=Z_1Z_2/(Z_1+Z_2)=Z_c=(R^2+X^2)/(2R)$.

It is further advantageous, if a distance between said reflector means and said back face of said dielectric substrate is between $0{,}25\lambda$ and $0{,}5\lambda$, wherein $\lambda$ is the electric wavelength of the central frequency (middle frequency of the working band) within the low loss material. Thereby, the radiation pattern of the antenna according to the present invention can be adopted to the required application. If the antenna is to be used in an uniform coverage application, as for example shown in FIG. 1, the distance H should be $H=0{,}45\lambda+/-5\%$. In this case, a radiation pattern close to the radiation pattern shown in FIG. 2 is obtained. In this radiation pattern, the gain Gmin in the direction of the central axis A of the antenna is about 12 dB less than the maximum gain Gmax. In case that the antenna is to be used in an outdoor application, as shown in FIG. 3, the distance H should be $H=0{,}5\lambda$, so that a radiation pattern close to the radiation pattern shown in FIG. 4 is obtained. In this radiation pattern, the radiation in the direction of the central axis A of the antenna is 0 in an ideal case.

Said first and said second subantenna means and said transmission line means can be located on the same face of said dielectric substrate, whereby said transmission line means comprises a first line connected with said first elements and a second line connected with said second elements, said first line and said second line being coplanar to each other.

Further on, said first and said second subantenna means can be located on the same face of said dielectric substrate, whereby said transmission line means comprises a first line and a second line forming a balanced microstrip line means and being connected laterally with said first and said second elements, respectively. Also, said first and said second elements of each of said subantenna means can be located on a different face of said dielectric substrate, respectively, whereby said transmission line means comprises a first line and a second line being printed on a different face of said dielectric substrate, respectively, and forming the balanced microstrip line means, whereby said first line is connected with said first elements and said second line is connected with said second elements.

Advantageously, said first and said second element of said second subantenna means respectively comprise two parallel slots on a feeding side thereof. These slots are one possibility to obtain the conjugate complex impedances of the subantenna means.

Further on, said first and said second subantenna means and said transmission line means can be printed on said dielectric substrate, or they can be slots in a metal coated area on one of the faces of the dielectric substrate. In the first case, the subantenna means can be dipole means. In the second case, in which said first and said second subantenna means and said transmission line means are slots in a metal coated area on one of the faces of said dielectric substrate, said transmission line means is formed as a coplanar strip line. For a particular application, the antenna according to the present invention can be arranged as an antenna element in a phase antenna array comprising a plurality of antenna elements according to the present invention.

Figure 5:
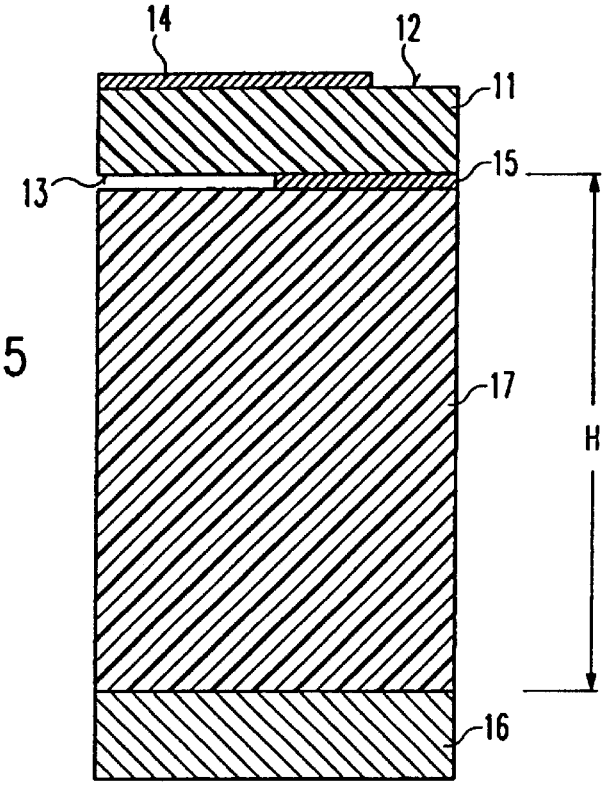
Figure 6:
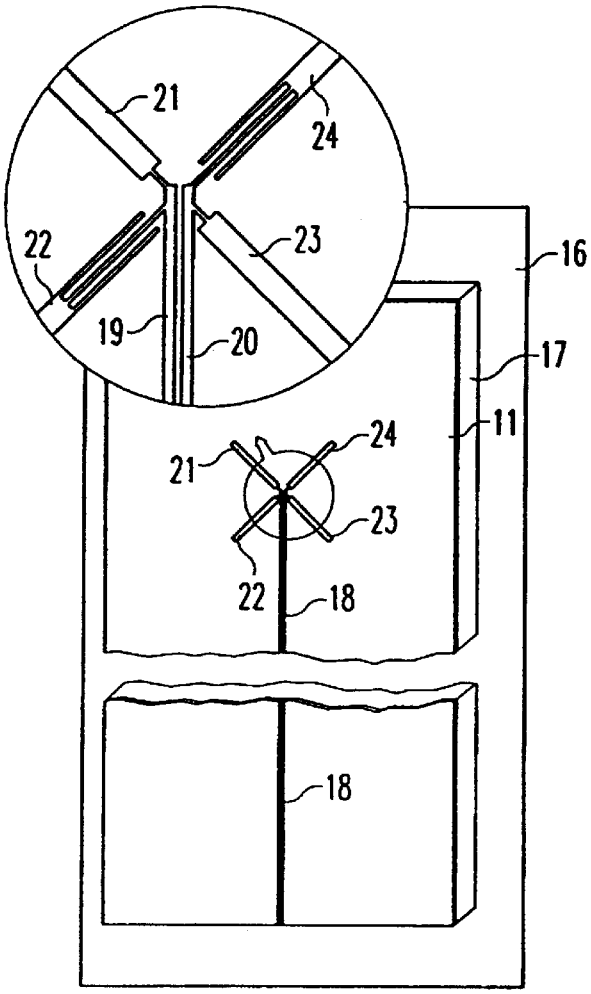
Figure 7:
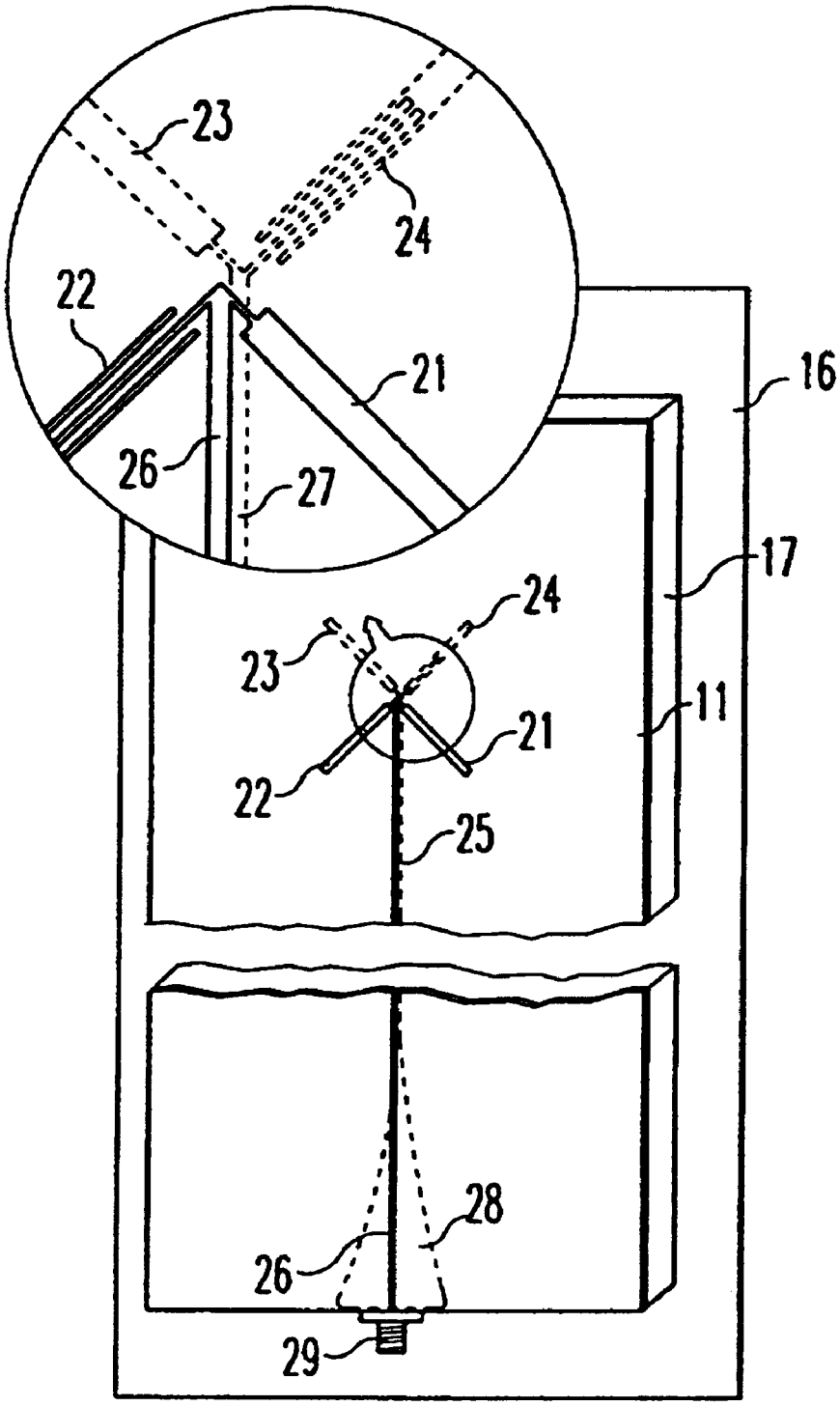
Figure 8:
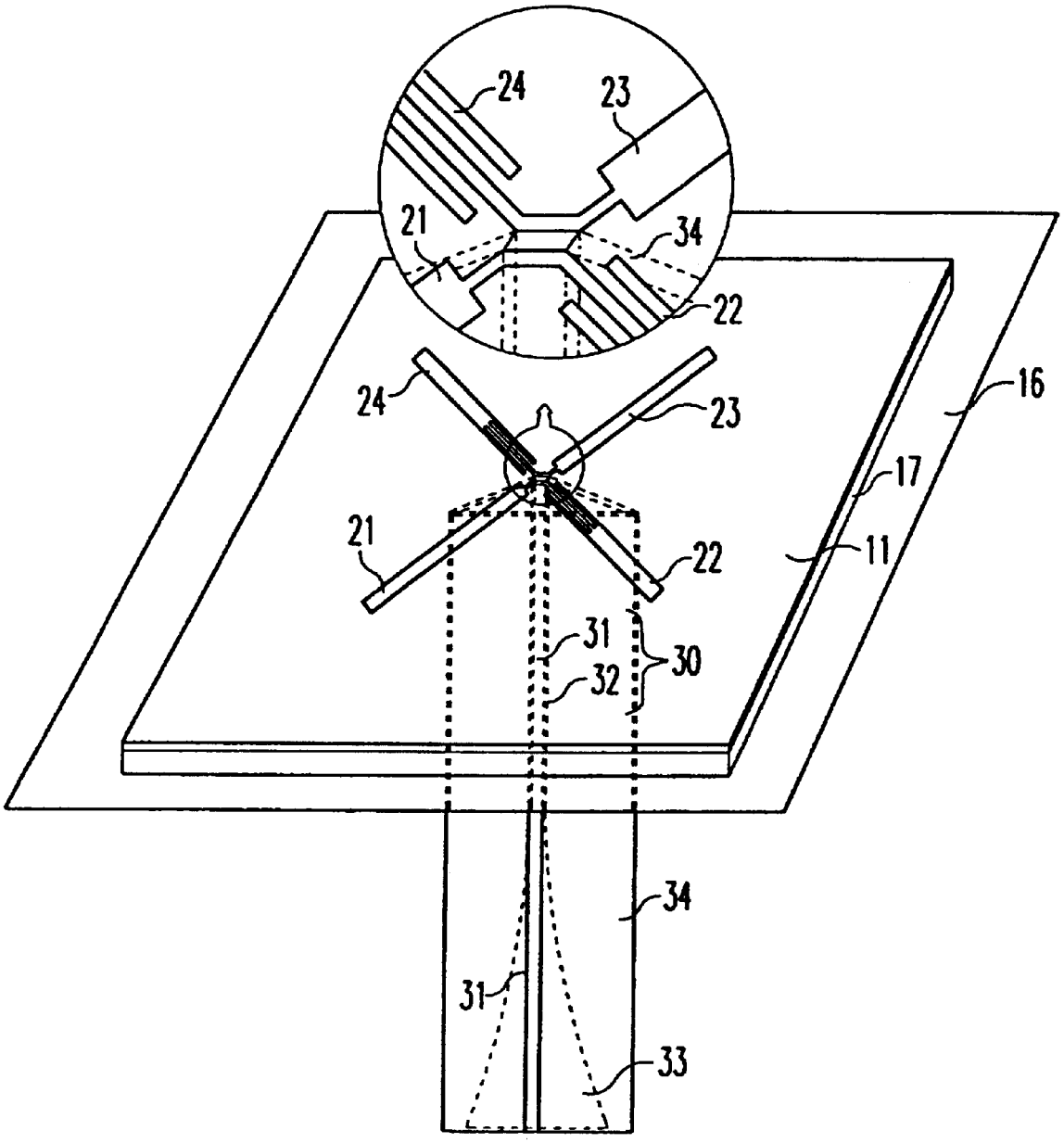
Figure 9:
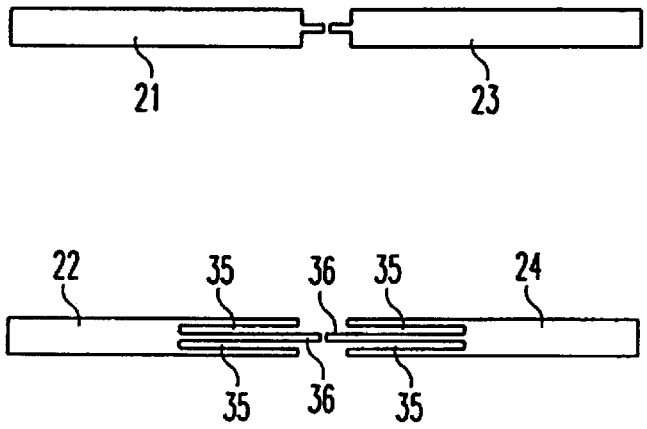
Figure 10:
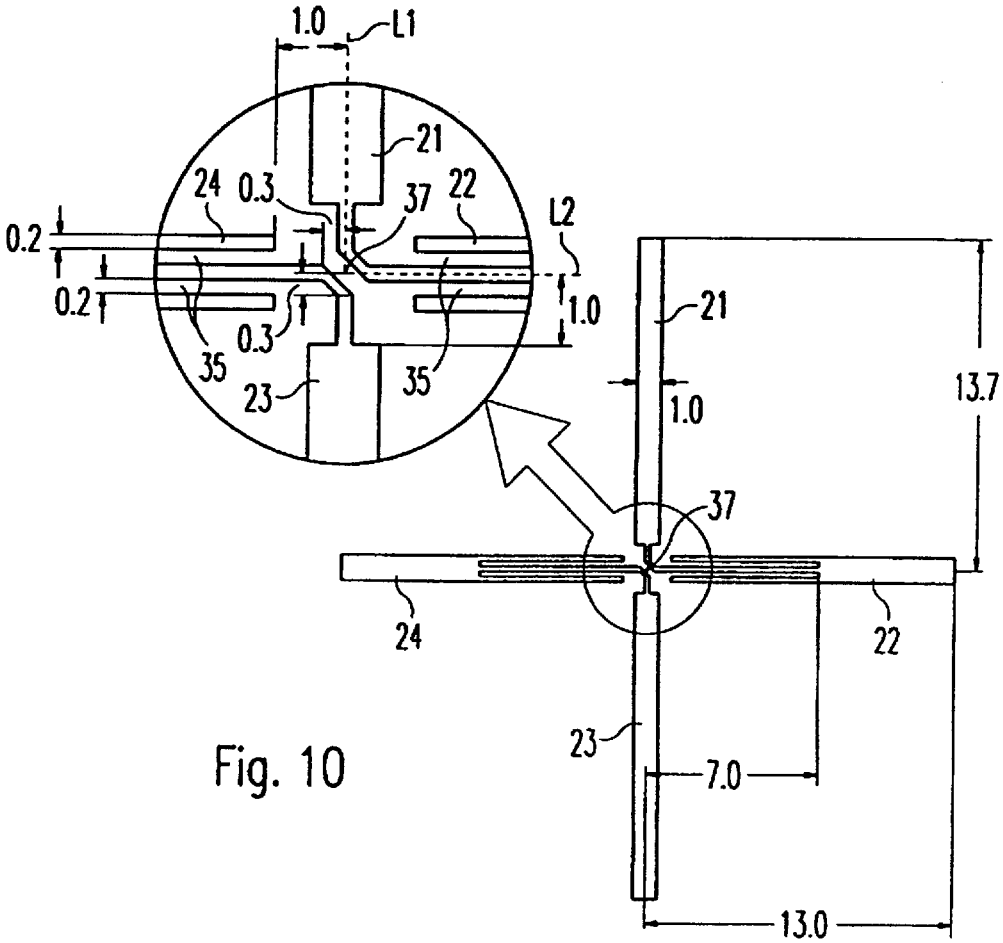
Figure 11:
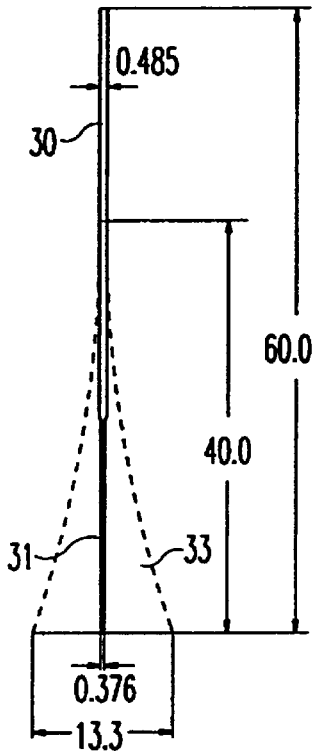
Figure 12:
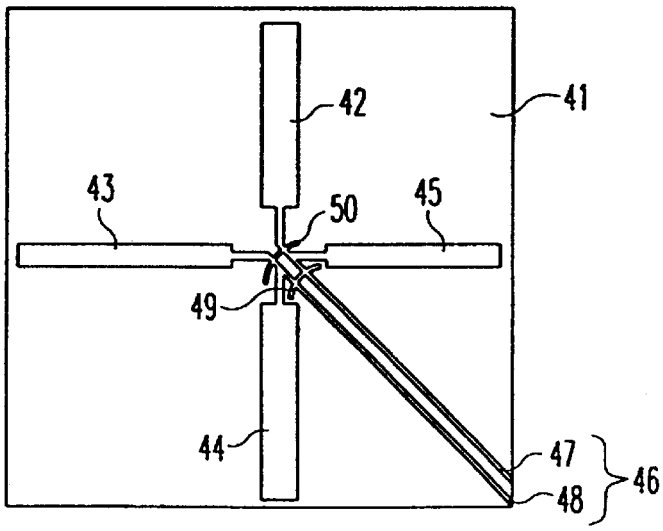
Figure 13:
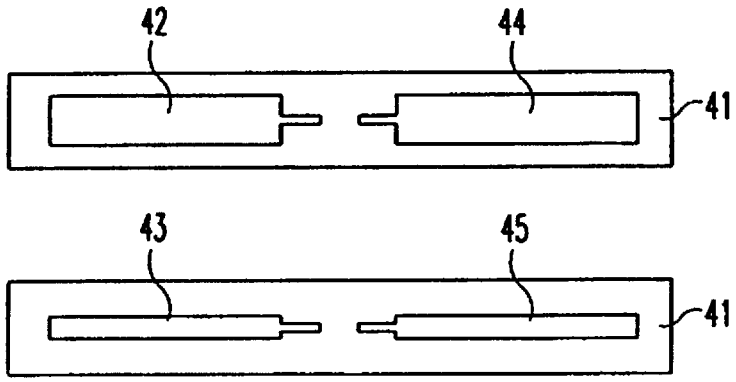
Figure 14:
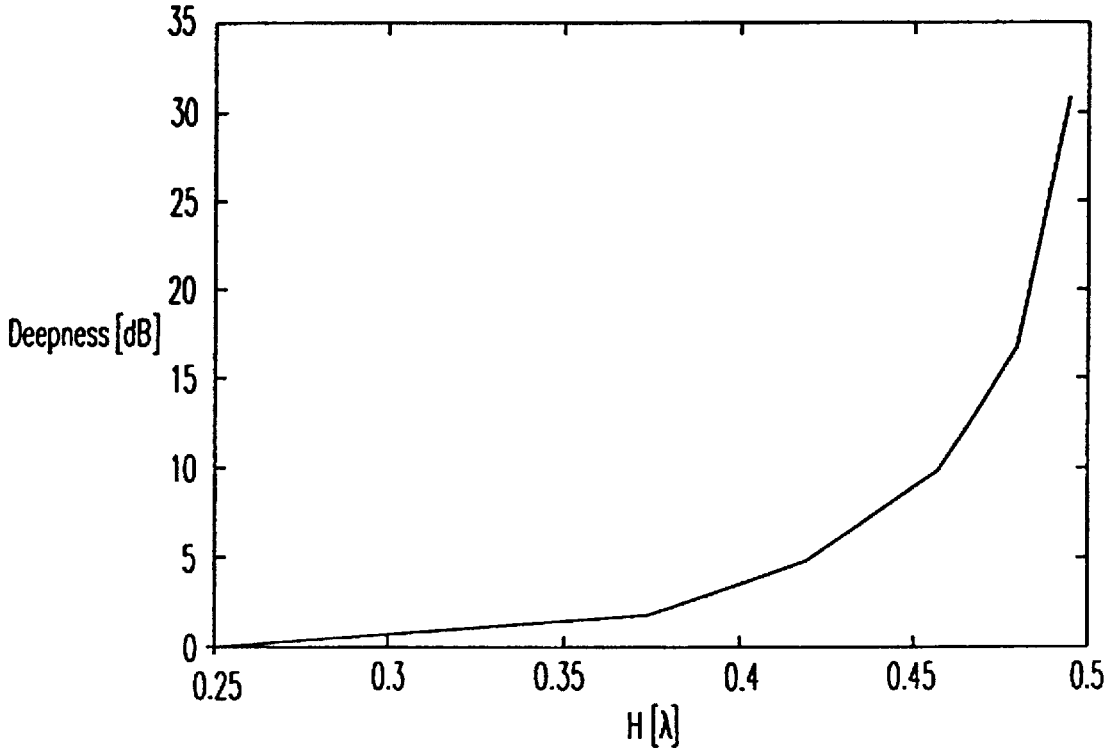
Figure 15:
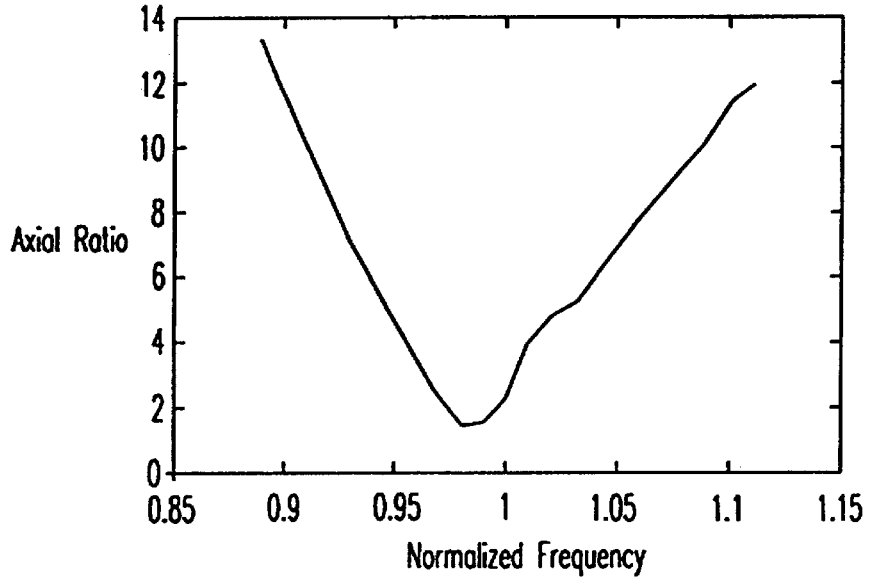
Figure 16:
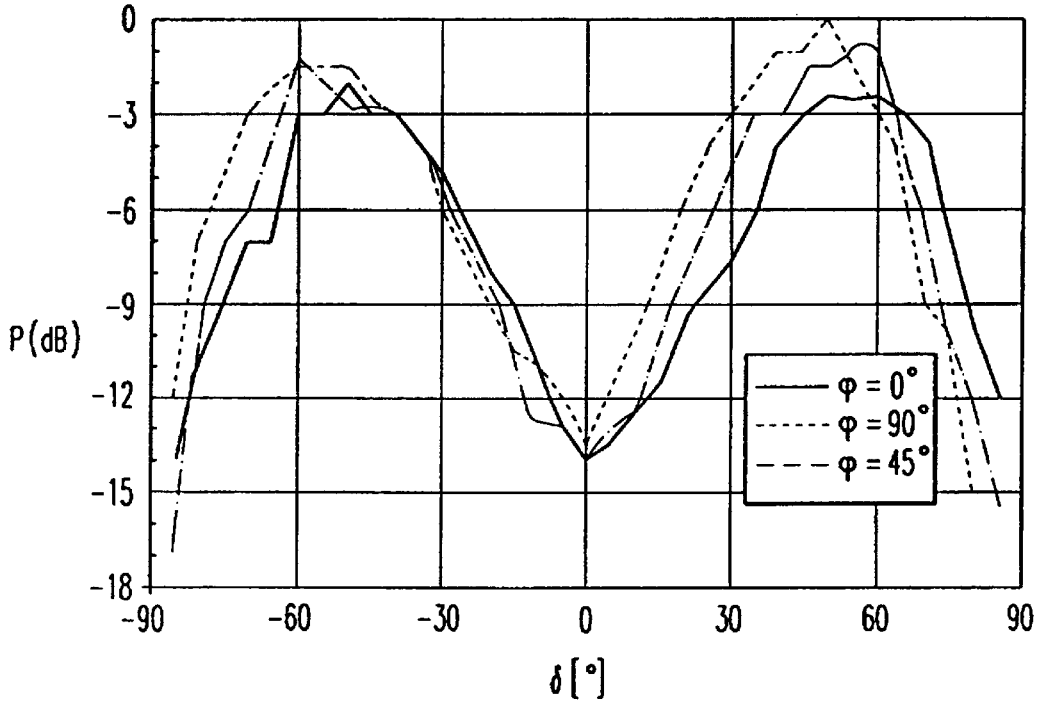
Figure 17:
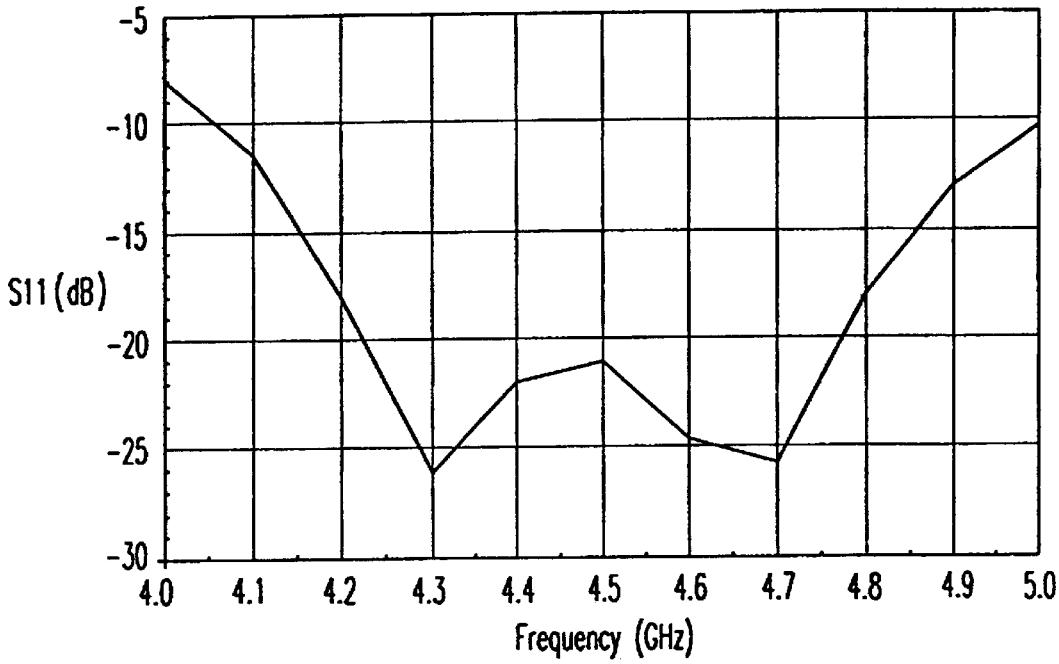
Figure 18:
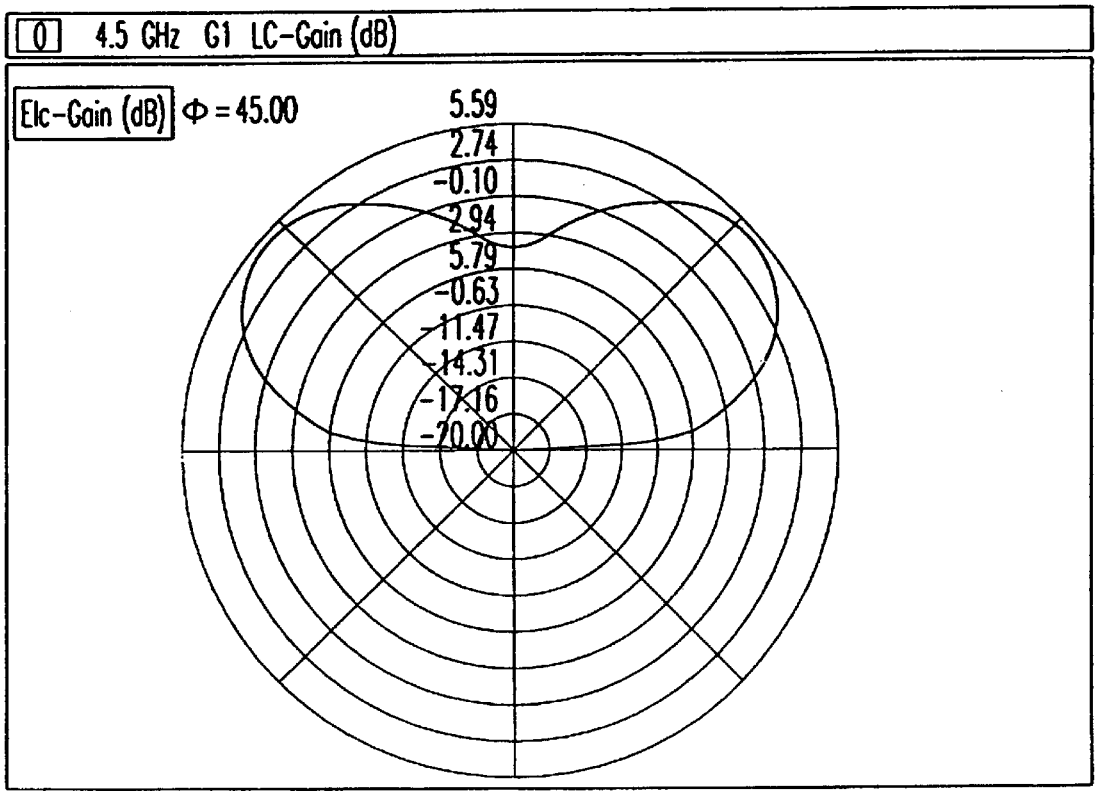

In the following description, the present invention is explained by means of advantageous embodiments in view of respective drawings, in which FIG. 1 shows the scenario of an uniform coverage application, FIG. 2 shows an ideal radiation pattern for an uniform coverage application, FIG. 3 shows a scenario of an outdoor application, FIG. 4 shows an ideal radiation pattern for an outdoor application, FIG. 5 shows a cross-sectional view of an antenna according to the present invention, in which the first and the second elements are printed on respective different faces of the dielectric substrate, FIG. 6 shows a perspective view of a first embodiment of the present invention, FIG. 7 shows a perspective view of a second embodiment of the present invention, FIG. 8 shows a perspective view of a third embodiment of the present invention, FIG. 9 shows the particular shape of the dipole elements used in the first, second and third embodiment, FIG. 10 shows an example for the dimensions of the dipole means of the third embodiment for an application at 4,5 GHz, FIG. 11 shows an example of the dimensions of the applied BALUN-transmission at 4,5 GHz, FIG. 12 shows a top view of a fourth embodiment of the antenna according to the present invention, in which the subantenna means are slots, FIG. 13 shows an example for the shape of the slots means used in the fourth embodiment of the present invention, FIG. 14 shows the gain in the direction of the central axis of the antenna related to the maximum gain versus the distance H of the reflector plane for an antenna according to the present invention at 4.5 GHz, FIG. 15 shows an axial ratio of an antenna according to the present invention for 4.5 GHz, FIG. 16 shows a measured antenna diagram for an antenna according to the present invention at 4,5 GHz, FIG. 17 shows the antenna return loss versus the frequency, and FIG. 18 shows a simulated antenna pattern at 4,5 GHz.

In FIG. 1, a typical indoor environment for an uniform coverage application of an antenna according to the present invention is shown. An antenna 1 according to the present invention is fixed to the ceiling 2 and serves as a base station or a remote station omnidirectional antenna for the communication with several mobile or portable antennas 5, 7. One antenna 5 is located on a laptop 4 and another antenna 7 is located on a personal computer 6. As has been explained above, FIG. 1 also shows an ideal radiation pattern which is shown in more detail in FIG. 2. The antenna 1 according to the present invention can be built to have a radiation pattern very close to this shown ideal radiation pattern, as will be explained later. In an indoor application, the radiation pattern of the antenna according to the present invention should have a minimum gain Gmin in the direction of a central axis A of the antenna 1, which is 12–18 dB less than the maximum gain Gmax at an angle Φ of about 60°–70° for a cell diameter between 12 m and 24 m. The ideal radiation pattern shown in FIG. 1 and FIG. 2 is given by the above-explained equation and depends on the above-identified parameters.

In FIG. 3, a typical outdoor application for the communication of the antenna 1 according to the present invention with a stationary satellite 8 is shown. The antenna 1 is located for example on the roof of a car 9 and has a radiation pattern as shown in more detail in FIG. 4. This ideal radiation pattern has a maximum gain for an angle Φ between about 30° and 70°, whereby Φ is the angle between the central axis A of the antenna 1 and the transmission direction. The gain in the direction of a central axis A of the antenna 1 is zero. The antenna 1 according to the present invention can also be built to have a radiation pattern very close to the ideal radiation pattern shown in FIG. 4 as will be explained later.

In both of the applications shown in FIG. 1 and FIG. 3, the antenna 1 of the present invention should have an omnidirectional pattern in the orthogonal plane.

In FIG. 5, a cross-sectional view of an antenna 1 according to the present invention is shown. A dielectric substrate 11 has a front face 12 and a back face 13. On the front face 12 and/or on the back face 13, first subantenna means 14 and second subantenna means 15 are located. In the example shown in FIG. 5, the first elements are printed on the front face 12, and the second elements are printed on the back face 13. However, the first subantenna means 14 and the second subantenna means 15 can be printed both on the front face 12 or on the back face 13. Advantageously, the first and second subantenna means 14, 15 are realized with a metallization, as shown in FIG. 4.

Alternatively, the first subantenna means 14 and the second subantenna means 15 can be slots realized on the front face 12, which will be explained later relating to FIG. 12 and FIG. 13.

The dielectric substrate 11 is supported by a low-loss material 17, on the opposite side of which a reflector means 16 in form of a metal reflector plane is located. The low-loss material 17 can be polyurethane, a free space or some other low-loss material with a dielectric constant close to 1.

In order to obtain a radiation pattern close to the ideal radiation patterns shown in FIGS. 2 and 4, the distance H between an upper face of said reflector means 16 and back face 13 of said dielectric substance 11 should have a correspondingly adopted value. The value of the distance H is generally between 0.25λ and 0.5λ, wherein λ is the electric wavelength of the central frequency (middle of the working band) within the low-loss material 7. For an uniform coverage application as shown in FIG. 1, where there is a need to have e.g. a 12 dB less gain in the direction of the central axis A of the antenna 1 compared to the maximum gain Gmax, the distance H has a value of $H=0.45\lambda\pm5\%$. For an outdoor application as shown in FIG. 3, H has a value of $H=0.5\lambda$, so that the theoretical radiation in the direction of the central axis A of the antenna 1 is zero.

In FIG. 6, a perspective view of a first embodiment of the antenna 1 according to the present invention is shown. In the first embodiment, the feeding of the antenna 1 is realized by coplanar strips. The low-loss material 17 has a reflector plane 16 on its lower side and a dielectric substrate 11 on its upper side. In the first embodiment shown in FIG. 6, the first and second subantenna means 14, 15 are dipoles printed on the front face 12 of the dielectric substrate 11. The first dipole 14 comprises a first element 21 and a second element 23, and the second dipole 15 comprises a first element 22 and a second element 24. The first dipole 14 and the second dipole 15 are orthogonal to each other and therefore the first element 21, the second element 22, the first element 23 and the second element 24 are also orthogonal to each other as can be seen in FIG. 6. The first dipole 14 and the second dipole 15 have essentially conjugated complex impedances for radiating and receiving circular polarized electromagnetic signals. A transmission line means 18 is connected with said first and second dipoles 14, 15 for transmitting signals to and from said first and second dipoles 14, 15.

As can be seen in the enlarged view in the circle in the upper section of FIG. 6, the transmission line means 18 comprises a first line 19 connected with said first elements 21, 22 and a second line 20 connected with said second elements 23, 24. The first line 19 and the second line 20 are coplanar to each other. As can be seen from FIG. 6, elements 22, 24 of the second dipole 15 have another shape as the elements 21, 23 of the first dipole 14. The elements 22 and 24 of the dipole 14, which are arranged opposite each other, have two parallel slots in their longitudinal direction, which will be explained in more detail in connection with FIG. 9. The elements 21, 23 of the first dipole 14 are shaped to have an impedance of (50−j50) Ohm and the elements 22, 24 of the first dipole 15 are shaped to have an impedance of (50+j50) Ohm.

FIG. 7 shows a second embodiment of an antenna according to the present invention in which the feeding of the antenna. In the second embodiment, the first element 21 and the first element 22 are printed on the front face 12 of the dielectric substrate 11, whereas the second element 23 and the second element 24 are printed on the back face 13 of the dielectric substrate 11. This feature can be seen in the upper part of FIG. 7 which shows a circle with an enlarged view of the first dipole means 14 and the second dipole means 15, whereby the second elements 23, 24 are shown by dotted lines to clarify that the second elements 23, 24 are printed on the back face 13. In the second embodiment, the elements 22 and 24 of the second dipole 15 have respectively two parallel slots in the longitudinal direction of the elements and are arranged opposite each other. As in the first embodiment, the first element 21 and the second element 23 of the first dipole 15 are arranged opposite each other. The transmission line means 25 of the second embodiment is different from the transmission line means 18 of the first embodiment. The transmission line means 25 in the second embodiment comprises a first line 26 and a second line 27. The first line 26 is printed on the front face 12 and the second line 27 is printed on the back face 13 of the dielectric substrate 11. The first line 26 and the second line 27 are parallel to each other and map with each other. The second line 27 has a broadened portion 28 on its side opposite from said elements 23 and 24 to form a balanced microstrip line means with said first line 26. A connector 29 connects the first line 26 and the second line 27 with further processing means. Thereby, the broadened portion 28 has a gradually increasing width is tapered towards the connector 29.

FIG. 8 shows a perspective view of the third embodiment of the antenna according to the present invention in which the feeding of the antenna is realized by a balanced microstrip line printed in a plane orthogonal to the antenna. In the third embodiment, the elements 21 and 23 and the elements 22 and 24 are printed on the front face 12 of the dielectric substrate 11 as in the first embodiment. The transmission line means 30 of the third embodiment comprises a first line 31 and a second line 32, whereby the first line 31 is printed onto a front face of a lateral plane 34 and the second line 32 is printed on a back face of the lateral plane 34 and are building a balanced microstrip line. As can be seen in the circle in the upper section of FIG. 8 showing an enlarged view of the portion connecting the dipole means 14 and 15 with the transmission line means 30, the lateral plane 34 is connected laterally through the low-loss material 17 and the dielectric substrate 11 with the dipole means 14 and 15. Thereby, the first line 31 is connected with the elements 21 and 22 and the second line 32 is connected with the elements 22 and 24. The second line 32 has a broadened portion 33 (tapered portion) similar to the broadened portion 22 (tapered portion) of the second line 27 in the second embodiment, so that the first line 31 and the second line 32 in the third embodiment also form a balanced microstrip line means.

In the first, second and third embodiment it is to be noted, that the length of the first and second lines of the respective transmission line means should be chosen not to influence the radiation pattern. Further on, the different transmission line means of the first, second and third embodiment respectively can also be used in the antennas of the respective other embodiments.

In FIG. 9, the shape of the elements 21 and 23 of the first dipole 14 and the elements 22 and 24 of the second dipole 15 used in the first, second and third embodiment are shown. The first elements 21 and 22 have an elongated rectangular shape. The second elements 23 and 24 also have a generally elongated rectangular shape, but have a pair of slots 35, respectively. The two slots 35 in each pair of slots are parallel to each other and extend in a longitudinal direction of the second elements 22 and 24. The slots 35 are located on the side of a respective feeding portion 36, on which the second elements 22, 24 are connected with the respective transmission line means. The slots 35 are coupling sections to cause the coupling of the transmitted or received signals with the bodies of the respective elements and are shaped to obtain the respectively wanted input impedance. The first elements 21 and 23 shown in FIG. 9 are shaped to have an impedance of about $Z_1$=(50−j50) Ohm and the second elements 22 and 24 are shaped to have an impedance of $Z_2$=(50+j50) Ohm, whereby the respective transmission line means has an impedance of 50 Ohm.

In FIG. 10, some examples for the dimensions of the elements 21 and 23 and the elements 22 and 24 for a frequency of 4.5 GHz in the case of the third embodiment are given. The material of the dielectric substrate 11 is Teflon-fiberglass with a dielectric constant of 2.17 and a width of 0.127 mm. The width of the elements 21, 22, 23, 24 is 1.0 mm and the length of the elements 21, 23 measured from the feeding point 37 is 13.7 mm. The length of the elements 22, 24 is 13.0 mm measured from the feeding point 37. The length of the slots 35 in the elements 22, 24 is 7.0 mm measured from the feeding point. An enlarged view of the area around the feeding point 37 is shown in the circle on the upper left side of FIG. 10. There it is shown, that the slots 35 have a width of 0.2 mm and the remaining tongue-like parts of the elements 22 and 24 have a width of 0.2 mm. Further on, the distance between the longitudinal axis L2 of the elements 22 and 24 and the body portion of the elements 21 and 23 is 1.0 mm. as well as the distance between the longitudinal axis L1 of the elements 21 and 23 and the beginning of the tongue-like portions of the elements 22, 24.

In FIG. 11, the dimensions for the transition from balanced to unbalanced transmission as for example used in the second and third embodiment is shown and explained relating to the third embodiment. The transmission line means 30 comprises the first line 31 and the second line 32 printed on the first and the second face 12, 13, respectively. The broadened portion 33 of the second line 32 has a width of 13.3 mm at the location of the connector 38, which might be an SMA-connector. The distance between the beginning of the broadening of the portion 33 to the broadest part of the portion 33 is 40.0 mm. The length from the broadest part of the broadened portion 33 to the feeding point, on which the first and second elements are connected, is 60.0 mm. The width of the first line 31 and the second line 32 is 0.485 mm, whereby the width of the first line 31 at the connector's side decreases to 0.376 mm. It is to be noted that the same type of transition can also be achieved with smaller dimensions.

FIG. 12 shows a fourth embodiment of the present invention. The first subantenna means 14 and the second subantenna means 15 in this embodiment are slots in a metal coated area 41 on one of the faces of the dielectric substrate 11. In the fourth embodiment, the first slot means 14 comprises a first element 42 and a second element 44 and the second slot means 15 comprises a first element 43 and a second element 45. The first elements 42 and 43 have an elongated rectangular shape and are arranged opposite to each other. The second elements 44 and 45 also have an elongated rectangular shape, but have a smaller width than the first elements 42 and 43. The elements 42, 43, 44 and 45 are arranged orthogonal to each other. The transmission line means 46 for transmitting electromagnetic signals to and from the first and the second elements comprises a first line 47 and a second line 48, which are formed as slots in the metal coating 41. The feeding of the orthogonal slots is realized by a coplanar waveguide structure 46 suppressing unwanted electromagnetic modes. Their number can be extended along the whole coplanar waveguide line 46. Therefore, in the fourth embodiment, the first slot means and the second slot means are connected in series.

In FIG. 13, the shape of the first elements 42 and 43 and the second elements 44 and 45 are shown in more detail. It is easily to be seen that the width of the first elements 42 and 43 is larger than the width of the second elements 44 and 45. The impedance of the first elements 42 and 43 of the fourth embodiment is about $Z_1$=(25−j25) Ohm and the impedance of the second elements 44 and 45 of the fourth embodiment is about $Z_2$=(25+j25) Ohm, whereby the transmission line means 46 has an impedance of 50 Ohm. Due to the serial connection of the first slot means 14 and the second slot means 15 in the fourth embodiment, the resulting impedance of the first and second slot means equals the impedance of the transmission line means 46. It is to be noted that the dimensions of the first and second elements of the fourth embodiment are calculated using the dual complementary theory of dipoles and slots, so that instead of simulating slots with the impedance of (25+j25) Ohm and (25−j25) Ohm the dipoles printed on the dielectric substrate 11 can be simulated with an impedance of (709.52−j709.52) Ohm and (709.52+j709.52) Ohm. Using this idea, the principle shapes of the first and second elements of the fourth embodiment are as shown in FIG. 13.

FIG. 14 presents one of the main advantages of the present invention, namely how to shape the circular polarized radiation pattern by changing the distance H from the dipoles to the reflector plane.

In FIG. 14, the gain in the middle antenna diagram (elevation angle is 90°) related to the maximum gain versus the distance of the reflector plane of a planar printed antenna mounted according to the dimensions shown and explained in view of FIGS. 10 and 11 for a frequency of 4.5 GHz is shown. The horizontal axis represents the distance H from the middle plane of the dielectric substrate 11 to the reflector plane of the reflector means 16 in units of λ, which is the electric wavelength of the central frequency in the low-loss material 17, whereas the vertical axis represents the deepness in the unit of dB.

It is to be noted, that in the case where the value of H=0.5λ is achieved, theoretically there is no radiation in the direction of a central axis A of the antenna according to the present invention, which is in coincidence with the outdoor application shown in FIG. 3. In the case of H=0.25λ, the antenna radiates with Gmin, which is the maximum gain in the direction of the central axis A. Depending on the applications, the different distances H from the reflector plane can be utilized to adopt the antenna according to the present invention to the working scenario requirements.

The curve shown in FIG. 14 is at the same time the design curve for the antenna according to the present invention. The design procedure for an antenna for an indoor application should be used in the following way. First, the required deepness in the middle of the diagram should be calculated according to the application scenario. Then, the approximate distance H should be read using the curve shown in FIG. 14. Then, the orthogonal dipole elements are designed in view of an optimization of their dimensions with a prescribed distance in order to meet the required input impedances using a 3D electromagnetic simulator with the scaled dimensions shown in FIG. 10 for the first estimate. After meeting the impedance requirements, a fine tuning of the distance to the reflector plane should be performed to meet more efficiently the corresponding deepness requirements. The above process steps should be repeated or iterated using simulation tools.

It is to be noted, that fine iterations by simulations should be performed in the case where a finite reflector plane is considered.

In FIG. 15, a simulated axial ratio of an antenna according to the present invention is shown over the normalized frequency. The graph shows about 13% bandwidth for an axial ratio of 6 dB and about 3,1% bandwidth for an axial ratio of 3 dB. The simulations shown in FIG. 15 have been made for a frequency of 4,5 GHz.

In FIG. 16, a measured antenna diagram (elevation) is shown. The antenna diagram shows the gain P in dB versus the azimuth angle δ in degrees for three different elevation angles ϕ=0°, 45° and 90°. It is to be noted, that only a simple non-automatic measurement technique has been applied, where an error of +/−1 dB should be expected.

In FIG. 17, the reflection coefficient S11 in dB versus the frequency in GHz for an antenna according to the present invention is shown. The gain measurements have been performed using a reference horn antenna with a non-automatic approach, therefore the antenna diagram shown in FIG. 16 does not have a smooth shape. The measured maximum omnidirectional ripple of the gain does not exceed the value of 1,5 dB in the whole frequency range of interest. It is to be noted that all of the simulated diagrams are obtained via 3D full wave simulations, where the influence of the dielectric thickness has been neglected.

FIG. 18 shows a simulation antenna pattern of an antenna according to the present invention at 4,5 GHz. It can be seen that it comes very close to the ideal radiation pattern shown in FIG. 2.

What is claimed is:

1. An antenna with a dielectric substrate (11) comprising a front and a back dielectric face (12, 13), a first and a second subantenna means (14, 15), each comprising a first and a second element for radiating and receiving circular polarized electromagnetic signals, said first and second subantenna means (14, 15) being arranged orthogonal to each other on said dielectric substrate (11) and having essentially conjugate complex impedances, a transmission line means (18, 25, 30, 46) connected with said first and second subantenna means (14, 15) for transmitting signals to and from said first and second subantenna means, and a reflector means (16) spaced to and parallel with said back face (23) of said dielectric substrate (11), a low loss material (17) being located between said reflector means (16) and said back face (13), wherein a distance H between said reflector means (16) and said back face (13) of said dielectric substrate (11) is between 0,25λ and 0,50λ, wherein λ is the electric wavelength of the central frequency within the low loss material.

2. The antenna according to claim 1, characterized in that said first and said second subantenna means (14, 15) are dipole means connected in parallel by said transmission line means (18, 25, 30).

3.The antenna according to claim 1, characterized in that said first and said second subantenna means (14, 15) are slots connected in series by said transmission line means (46).

4. The antenna according to claim 1, characterized in, that said first and said second subantenna means (14, 15) and said transmission line means (18) are located on the same face (12) of said dielectric substrate (11) and said transmission line means (18) comprises a first line (19) connected with said first elements (21, 22) of said first and second subantenna means (14, 15) and a second line (20) connected with said second elements (23, 24) of said first and second subantenna means (14, 15), said first line (19) and said second line (20) being coplanar to each other.

5. The antenna according to claim 1, characterized in, that said first and said second subantenna means are located on the front face (12) of said dielectric substrate (11) and said transmission line means (30) comprises a first line (31) and a second line (32) forming a balanced microstrip line means and being connected laterally with said first and said second elements (21, 22 and 23, 24) respectively.

6. The antenna according to claim 1, characterized in, that said first and said second elements (21, 23 and 22, 24) of each of said subantenna means are located on a different face (12, 13) of said dielectric substrate, respectively, and said transmission line means (25) comprises a first line (26) and a second line (27) located on a different face of said dielectric substrate, respectively, and forming a balanced microstrip line means, wherein said first line (26) is connected with said first elements (21, 22) and said second line (27) is connected with said second elements (23, 24).

7. The antenna according to claim 1, characterized in, that said first and second element of said second subantenna means (15) respectively comprise coupling sections (35) on a feeding side (36) thereof.

8. The antenna according to claim 1, characterized in, that said first and said second subantenna means (14, 15) and said transmission line means (18, 25, 30) are printed on said dielectric substrate.

9. The antenna according to claim 1, characterized in, that said first and said second subantenna means (14, 15) and said transmission line means (46) are slots in a metal coated area (41) on one of the faces (12) of said dielectric substrate (11).

10. The antenna according to claim 9, characterized in, that said slots are fed by said transmission line means (46), which is formed as a coplanar strip line.

11. The antenna according to claim 1, characterized in that arranged as an antenna element in a phase antenna array comprising a plurality of antenna elements.

* * * * *